US010850824B2

(12) United States Patent
Boyes

(10) Patent No.: US 10,850,824 B2
(45) Date of Patent: Dec. 1, 2020

(54) REDUNDANT STEERING SYSTEM FOR WATERBORNE VESSELS

(71) Applicant: Robert Boyes, Owingsville, KY (US)

(72) Inventor: Robert Boyes, Owingsville, KY (US)

( * ) Notice: Subject to any disclaimer, the term of this patent is extended or adjusted under 35 U.S.C. 154(b) by 0 days.

(21) Appl. No.: 16/230,746

(22) Filed: Dec. 21, 2018

(65) Prior Publication Data

US 2020/0198749 A1 Jun. 25, 2020

(51) Int. Cl.

| | |
|---|---|
| ***B63H 25/04*** | (2006.01) |
| ***B63H 25/16*** | (2006.01) |
| ***B63H 25/12*** | (2006.01) |

(52) U.S. Cl.

CPC ..... *B63H 25/04* (2013.01); *B63H 25/12* (2013.01); *B63H 25/16* (2013.01)

(58) Field of Classification Search

CPC ..... B63H 25/04; B63H 25/12; B63H 25/16
See application file for complete search history.

(56) References Cited

U.S. PATENT DOCUMENTS

| | | | | |
|---|---|---|---|---|
| 3,368,351 A * | 2/1968 | Wood | B64C 13/504 60/405 |
| 4,342,275 A * | 8/1982 | Brix | B63H 25/30 114/162 |
| 6,026,759 A * | 2/2000 | Hazelett | B63B 39/06 114/126 |
| 7,469,168 B1 * | 12/2008 | Richey | B63H 25/02 114/144 E |
| 2017/0101166 A1 * | 4/2017 | Gai | B63H 21/265 |

FOREIGN PATENT DOCUMENTS

WO WO-2015121233 A1 * 8/2015 ..... B63H 25/30

* cited by examiner

*Primary Examiner* — Stephen P Avila
(74) *Attorney, Agent, or Firm* — Francis Law Firm PLLC; James M. Francis

(57) ABSTRACT

A redundant steering system for watercraft that transfers rudder control to an electronic steering system when a hydraulic steering system either fails or is under repair. The electronic steering system utilizes either a fueled generator or a battery or series of batteries to power electric steering and flanking motors that serve control the angular position of the rudders.

21 Claims, 2 Drawing Sheets

REDUNDANT STEERING SYSTEM FOR WATERBORNE VESSELS

CROSS REFERENCE TO RELATED APPLICATIONS

This application derives priority from U.S. Provisional Patent Application 62/608,928 filed Dec. 21, 2017.

TECHNICAL FIELD

The apparatus of the present application relates generally to steering systems, and more specifically to redundant steering systems for watercraft.

BACKGROUND

When a boat's hydraulic steering system experiences failure or needs to be disabled for repairs, the shutdown can be more than inconvenient in that the down time can be expensive, it can be dangerous in that the boat may drift uncontrolled. An uncontrolled boat drifting with the current can risk the safety of the crew and be a danger to other maritime traffic. Additionally, a drifting vessel can pose a danger to cargo and to critical infrastructure such as bridges and ports. This is especially true of boats guiding barges on rivers due to the momentum of the barge and the sheer mass of the barge and its cargo.

Accidents because of steering gear failure are all too common in the maritime industry. Such incidents have lead to serious accidents, causing heavy damage to ship, its crew and the environment. It would be beneficial to have a redundant steering system that did not rely upon hydraulics to steer the boat safely in an emergency situation.

Numerous problems are often associated with hydraulic steering systems. These problems can jeopardize the ship, the crew, other vessels, and critical infrastructure such as bridges, locks, and terminals. A backup steering system can provide emergency steering to avoid a catastrophe or can permit the vessel to continue its trip while repairs are being made rather than forcing the vessel to dock and experience significant downtime.

Leaking hydraulic fluid from compressors, fittings, and hoses can cause significant problems, especially from the loss of hydraulic pressure. Some of the main areas of leakages are cylinder-ram seals in hydraulic ram type steering gears and seals in the chambers of a rotary vane pump. Moreover, significant leakages can also cause safety hazards from their flammability. Sometimes these leaks are difficult to trace and difficult to rectify, which can be especially problematic for tug boats trying to control loaded barges near maritime traffic, docks, locks, terminals, and bridges.

Another common problem observed in steering gear system is the difference in the angle given at the helm and the actual rudder angle. This occurs due to wrong or insufficient adjustment of control and repeat back lever. To rectify this problem, the turn buckle attached to the rod of control and repeat back lever are to be precisely adjusted, which may be problematic at times when steering is critical.

The fuel consumption of the ship greatly depends on the efficiency of steering gear operation. If the steering gear is operating unsatisfactory, it will lead to delay in the estimated time of arrival of the ship and will increase main engine fuel consumption. A common reason for this problem is malfunctioning of safety valves or by pass valves in the system. Any problem in the control and repeat back lever will also lead to unsatisfactory steering. A backup system can provide a crew sufficient time to make necessary repairs without interrupting the trip, thus saving time and money.

Excessive noise and vibrations from the steering gear indicates entrapment of air in the system. Due to air bubbles in the oil, pumps and pipings are subjected to vibration and heavy noise. Air must be removed from the system using vent valve provided in the cylinder and pump specially after the system is replenished with new oil. If the valve located in the oil supply tank of the steering gear is throttled or closed, it will again develop air bubbles in the system. The excessive vibration can induce leaks and cause system failure.

Oil, i.e. hydraulic fluid, is the operating media in the steering gear system. Any abnormality in the parameters of oil will lead to other operations related problems in the steering gear. If there is increase in the oil temperature, it will directly reduce the viscosity of the oil and hamper the steering operation. The most common cause of increase in oil temperature is low oil level in the system.

The International Convention for the Safety of Life at Sea (SOLAS) requirement for steering gears says that the system must be capable of putting the rudder over from 35° on one side to 35° on the other side of the ship at its deepest seagoing draught and running at maximum ahead service speed. It may sometimes happen that the maximum angle reached by the rudder is less than prescribed or the rudder is overshooting the 35° mark. One of the main reasons for this problem is malfunctioning of limit switch fitted on the repeat back unit or on the auto pilot. This can result in decreased accuracy in steering which can be problematic when precision is required.

Hydraulic steering makes handling of maritime vessels easy and safe. Feedback is eliminated and holding a steady course is simplified because no steering effort is required until making steering changes.

In two-line manual systems the helm pump moves the hydraulic cylinder directly. In use, a clockwise turn of the steering wheel will send fluid from the helm unit into the starboard hydraulic line. This fluid will be pumped into the cylinder and either extend or retract the cylinder rod. Incoming fluid pushes a piston which is pinned to an external rod. As the piston is moved the rod is either extended or retracted, and the boat turns. Outgoing fluid from the other end of the cylinder is returned to the helm via the port side line. Three-line manual systems are pressurized and contain a separate reservoir and pressure-relief valve and are common on vessels up to 70 feet, i.e. 21 meters.

Larger boats and tug boats require a bigger system that can handle higher loads typically experienced at the rudder(s). Power hydraulic steering systems include two distinct operating circuits:

- A "manually-operated" hydraulic system of a standard helm pump and hydraulic cylinder (fitted with an integral servo cylinder and power steering valve), and
- A "power" steering system of either an engine-driven pump (conventional) or an electrically-operated power assist pump.

The manual circuit provides the control portion of the steering system, and the power circuit provides the power to turn the rudders. Such systems often employ a joystick type control.

There are two basic parts to a hydraulic system: the helm and the cylinder. More complicated systems may have fluid reservoirs, specialized valves, relief valves, autopilot pumps, etc. The helm consists of a hydraulic pump and a system of valves, which pumps fluid into the hydraulic lines. The pump is activated by turning the steering wheel, which causes a "swash plate" to press on a series of small piston pumps. The use of small pistons and ball bearings makes the pump action very smooth—nothing like a normal piston pump. The internal valve assembly acts as a check valve, preventing the outgoing fluid from returning, while effectively eliminating kickback to the wheel. The helm can serve several functions, incorporating a hydraulic fluid reservoir and a relief valve as well. Some systems have a helm, reservoir and relief valve as separate components.

In use, a clockwise turn of the steering wheel will send fluid from the Helm Unit into the starboard hydraulic line. This fluid will be pumped into the cylinder and either extend or retract the cylinder rod. Incoming fluid pushes a piston which is pinned to an external rod. As the piston is moved the rod is either extended or retracted, and the boat turns. Outgoing fluid from the other end of the cylinder is returned to the helm via the port side line.

The present apparatus recognizes and addresses the previously-mentioned long-felt needs and provides utility in meeting those needs in its various possible embodiments. To one of skill in this art who has the benefits of this disclosure's teachings, other and further objects and advantages will be clear, as well as others inherent therein. The disclosures herein are not intended to limit the scope of the invention, merely to provide context with which to understand the patent claims.

SUMMARY

The present application discloses a redundant steering system for watercraft that transfers rudder control to an electronic steering system when a hydraulic steering system either fails or is under repair. The electronic steering system utilizes either a fueled generator or a battery or series of batteries to power electric steering and flanking motors that serve control the angular position of the rudders.

DETAILED DESCRIPTION OF THE PREFERRED EMBODIMENTS

Figure 1:
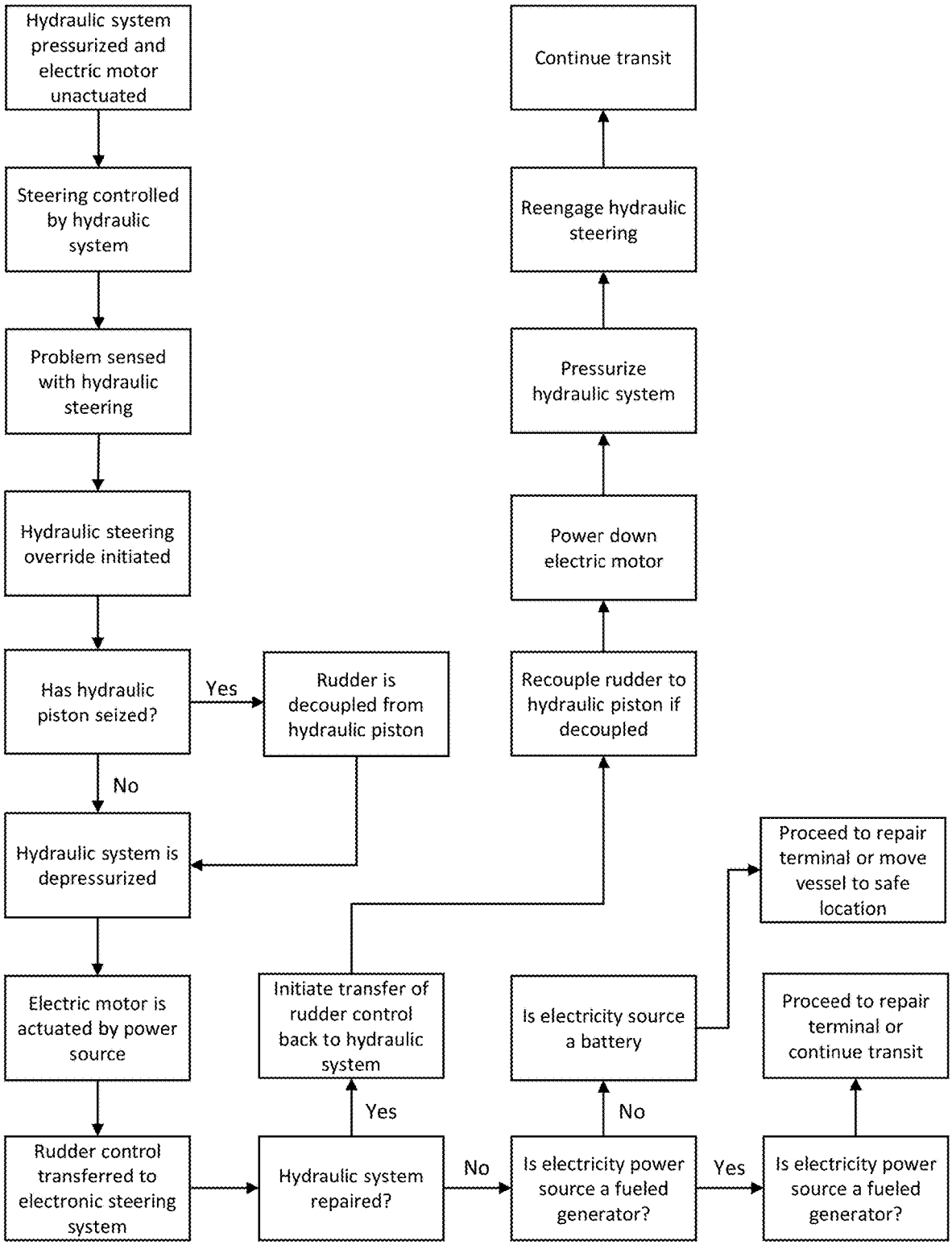
FIG. 1 depicts the process flow for the redundant steering system.
Figure 2:
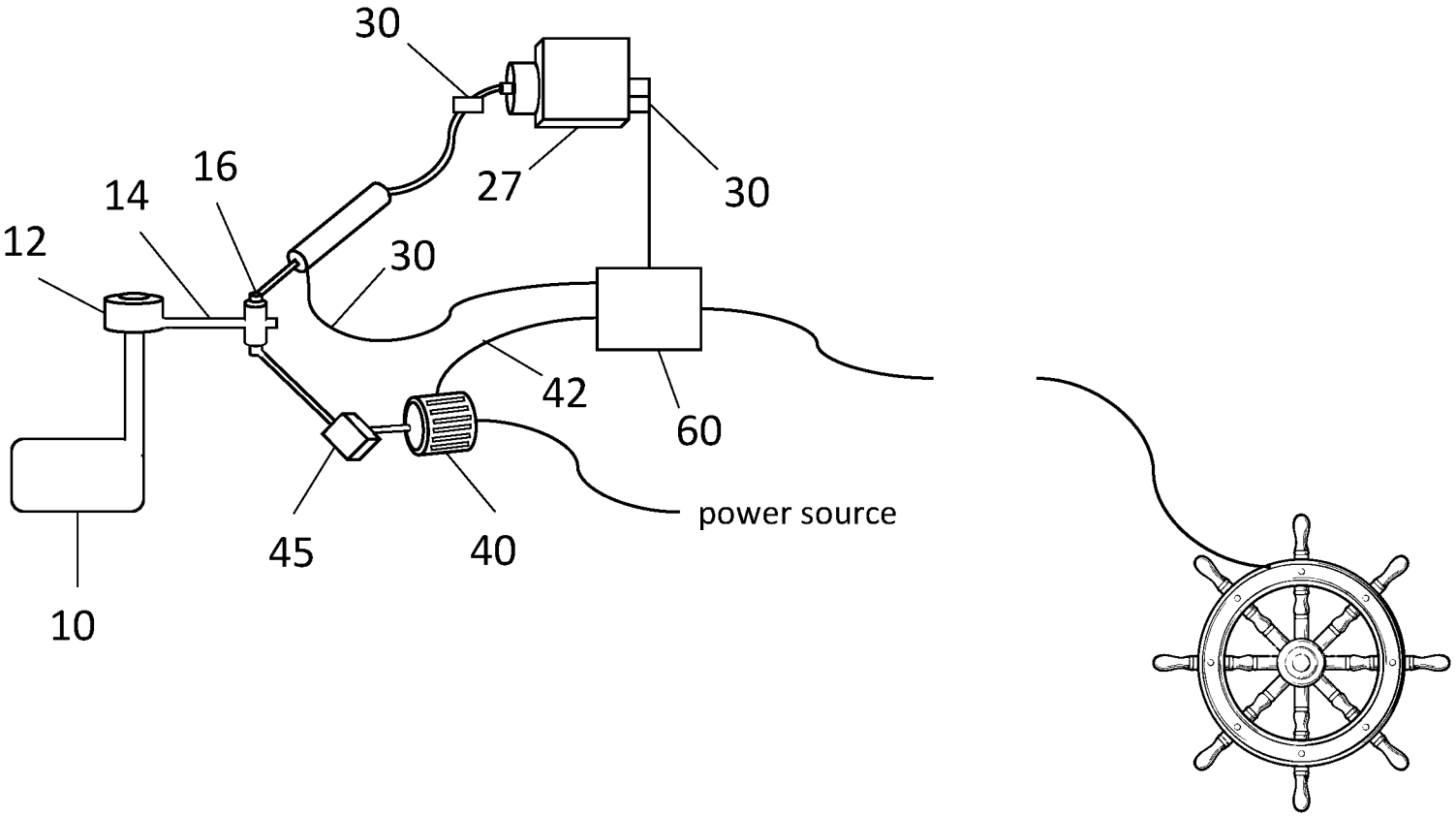
FIG. 2 depicts a schematic layout of the redundant steering system.

The system of the current application, as depicted in FIGS. 1-2 is a redundant steering system for watercraft, particularly small vessels that rely upon one or two compressors to generate a pressurized hydraulic fluid system. In the event of a hydraulic steering failure, the electrical redundant steering system of the present application can assume control of the rudders and allow the vessel to be steered to safety.

The method for utilizing a redundant electrical steering system requires switching from a failed or failing hydraulic steering system 80 by decoupling the hydraulic system from the rudder 10 prior to actuating the electronic rudder control system 100. Decoupling the hydraulic system 80 from the rudder 10 can be accomplished by depressurizing the hydraulic system 80 so as to untension the hydraulic piston 20 or other mechanism that controls the angular position of the rudder 10 or by mechanically decoupling the rudder 10 from the hydraulic system. Ideally, the hydraulic piston 20 that controls a rudder 10 will be freely moveable when the hydraulic pressure is relieved by a pressure relief valve 25 so that the rudders 10 become untensioned and move freely which permits the electronic rudder control system 100 to take control of the rudders 10. If a hydraulic piston 20 has seized and is unmovable or otherwise restricted from freely moving it, potentially renders the vessel unsteerable if coupled to a rudder 10. In this situation the hydraulic piston 20 must be mechanically decoupled from the rudder 10, preferably at the tiller arm-hydraulic piston joint 16, e.g. mechanically decoupling the tiller arm 14 that controls the rudder 10 from its corresponding hydraulic piston 20 of the hydraulic steering system 80, in order for the electronic steering system 100 to function properly. The tiller arm 14 is connected to the rudder at the tiller arm-rudder joint 12.

The electronic rudder control system 100 controls the rudder via actuation of an electric motor 40 in communication with the tiller arm 14 via a gear box 45 so as to transmit force from the electric motor 40 to the rudders 10. When the electric motor 40 is inactive, it remain in an untensioned state so as to not impede the control of the rudders 10 by the hydraulic system 80.

The operation of the electric motor 40 is preferably controlled in the wheelhouse by the electronic steering system. In an embodiment, the disclosed system provides electronic rudder control through an electric motor 40 powered by at least one deep-cycle battery 50. Typically, a deep cycle battery 50 will have two or three times the reserve capacity of a conventional vehicle lead-acid battery, but will deliver one-half to three-quarters of the cold cranking amps. In addition, a deep cycle battery can withstand several hundred total discharge/recharge cycles, while a conventional lead-acid battery is not designed to be totally discharged. Deep-cycle lead-acid batteries 50 generally fall into two distinct categories; flooded (FLA) and valve-regulated lead-acid (VRLA), with the VRLA type further subdivided into two types, Absorbed Glass Mat (AGM) and Gel. The battery 50 should ideally be discharged and recharged to maintain its viability, and may be maintained by trickle charge from the boat's generator to avoid degradation from processes such as sulfation. Alternatively, the battery 50 may be maintained by a trickle charge generated by solar, wind, and/or water power generation means. In a further embodiment, electricity is supplied to the electric motors 40 by a traditional internal combustion generator 55.

In an embodiment, 4 electric motors 40 (2 steering and 2 flanking) are utilized to drive the rudders 10. The system is ideally manually engaged in the wheelhouse and requires the depressurization of the hydraulic steering system and the release of the hydraulically controlled rudders 10 so that they will not affect steering as the pressure from the steering ram, e.g. hydraulic piston 20, is released back to a hydraulic fluid reservoir. Likewise, when the hydraulic system 80 is engaged, the electric motor 40 released is untensioned so as to not interfere with control of the rudders 10, i.e. the electric motors 40 move freely until engaged to drive the movement of the rudders 10 by the control system 60. The electric motors 40 are ideally installed so as to make them easily accessible for rapid changeout if necessary.

The electric motors 40 are engaged to turn the appropriate rudders 10, flanking or steering, by chain, belt, piston, or gears so as to provide either linear or rotary actuation to control the angular position of the rudders 10. The flanking rudders 10 turn together, as do the steering rudders 10. In an embodiment, the precise position of the rudders 10 is determined by an encoder in communication with the electric motor 40. A servomotor may be utilized as the electric motor 40.

In an embodiment, the electronic steering system 100 mechanically controls the angular position of the rudders through the actuation of an electric motor 40. Alternatively, the system may employ a control system 60 employing a data processor for precise control of the rudders 10 and for feedback on electric motor performance 42 and steering system diagnostics. Steering may be accomplished by a control panel or a mechanical control to translate motion into signals, e.g. current, to control the actuation of the electric motors so as to position and hold the rudders 10. In yet a further embodiment, a control system 60 monitors variables reflecting the operation and performance of at least one of the hydraulic steering system 80 and the electronic steering system through various sensor feeds 30, 42. Ideally the control system 60 at least monitors the hydraulic pressure in the hydraulic steering system 80 and controls the movement of the hydraulic piston 20 which controls the angular position of the rudder 10.

The control system 60, in a further embodiment, reports any malfunction such as a seized hydraulic piston 20 or loss of control of a rudder 10. Preferably, the control system 60 also controls and reports on the electronic steering system 100. In a yet further embodiment, the control system 60 overrides the hydraulic system 80 and automatically transfers control of the rudders 10 to the electronic steering system 100 in the event of loss of control of the rudders 10 and alerts the crew of the malfunction.

Ideally, engaging the electronic steering system 100 automatically disengages the hydraulic steering system 80 and either releases the hydraulic pressure holding the hydraulically controlled rudders 10 in place, e.g. through the pressure relief valve 25 or causes the mechanical decoupling of the rudder 10 from the hydraulic piston 20 at the tiller arm-hydraulic piston joint 16. Alternatively, a user may engage a manual mechanical decoupling of the rudder 10 from the hydraulic piston 20 of the hydraulic steering system 80 either as a primary step or as a failsafe should the control system 60 fail to decouple the rudder 10 from the hydraulic steering system 80. The control system 60 also permits the user to transfer control of the rudder 10 to an electronic steering system 100 on demand so as to permit the repair or maintenance of the hydraulic steering system 80 while in transit.

The provided examples herein are intended only for exemplary purposes only and are not intended to limit the scope of the system. Alternative embodiments are understood to become obvious to one skilled and the art upon reading this disclosure.

What is claimed is:

1. A maritime steering system comprising:

(a) at least one rudder in communication with a steering mechanism, wherein the angular position of said rudder is controlled by a hydraulic cylinder as part of a hydraulic steering system;

(b) at least one electric motor affixed to said rudder, said electric motor being untensioned while said hydraulic cylinder is tensioned, said electric motor being part of an electronic steering system to control the angular position of said rudder; and (c) a power source for said electric motor.

2. The steering system of claim 1, further comprising a hydraulic steering system override to switch the control of said rudder from said hydraulic steering system to said electronic steering system, said hydraulic steering system override causing the decoupling of said hydraulic steering system from said rudder and the actuation of said electric motor.

3. The steering system of claim 2, wherein said hydraulic system may be decoupled from said rudder by physically decoupling a tiller arm controlling the angular position of said rudder from said hydraulic steering system.

4. The steering system of claim 2, wherein said hydraulic system is decoupled from said rudder by depressurizing said hydraulic system so as to reduce the resistance to free movement of said hydraulic piston.

5. The steering system of claim 1, wherein said power source is selected from the group consisting of batteries and a fuel powered generator.

6. The steering system of claim 5, wherein said batteries are deep state batteries.

7. The steering system of claim 1, wherein said rudder is selected from the group comprising steering and flanking rudders.

8. The steering system of claim 1, wherein said steering mechanism is in communication with said electric motor which controls the movement of said rudder.

9. The steering system of claim 1, wherein the angular position of said rudder is controlled by a steering mechanism in communication with said electric motor but not in communication with said hydraulic piston.

10. The steering system of claim 1, wherein said electric motor is in communication with and controls the position of said tiller arm in communication with said rudder.

11. The steering system of claim 1, further comprising an electronic control system to sense and to report on variables related to the condition and operation of the steering systems and to permit the selection of said hydraulic steering system and said electronic steering system.

12. The steering system of claim 11, wherein a loss of hydraulic pressure in said hydraulic steering system triggers said control system to transfer control of said rudder to said electronic steering system.

13. The steering system of claim 12, wherein said control system alerts a user to the loss of hydraulic pressure.

14. A maritime steering system comprising:

(a) at least one rudder in communication with a steering mechanism, wherein the angular position of said rudder is controlled by a hydraulic cylinder as part of a hydraulic steering system;

(b) at least one electric motor affixed to said rudder, said electric motor being untensioned while said hydraulic cylinder is tensioned, said electric motor being part of an electronic steering system to control the angular position of said rudder;

(c) a power source for said electric motor; and (d) a hydraulic steering system override to switch the control of said rudder from said hydraulic steering system to said electronic steering system, said hydraulic steering system overide initiating the decoupling of said hydraulic steering system from said rudder and the actuation of said electric motor.

15. The steering system of claim 14, wherein said rudder is selected from the group comprising steering and flanking rudders.

16. The steering system of claim 15, wherein said hydraulic system may be decoupled from said rudder by physically decoupling a hydraulic piston from a tiller arm in communication with said rudder.

17. The steering system of claim 15, wherein said hydraulic system is decoupled from said rudder by depressurizing said hydraulic system so as to reduce the resistance to free movement of said hydraulic piston.

18. The steering system of claim 15, wherein the angular position of said rudder is controlled by a steering mechanism in communication with said electric motor but not in communication with said hydraulic piston.

19. The steering system of claim 14, wherein said electric motor is in communication with and controls the position of a tiller arm in communication with said rudder.

20. The steering system of claim 1, further comprising an electronic control system to sense and to report on variables related to the condition and operation of the steering systems and to permit the selection of said hydraulic steering system and said electronic steering system.

21. The steering system of claim 11, wherein a loss of hydraulic pressure in said hydraulic steering system triggers said control system to alert a user and transfer control of said rudder to said electronic steering system.

* * * * *